US009794691B2

(12) United States Patent
Werris

(10) Patent No.: US 9,794,691 B2
(45) Date of Patent: Oct. 17, 2017

(54) USING BONE TRANSDUCERS TO IMPLY POSITIONING OF AUDIO DATA RELATIVE TO A USER

(71) Applicant: Facebook, Inc., Menlo Park, CA (US)

(72) Inventor: Ian Werris, San Francisco, CA (US)

(73) Assignee: Facebook, Inc., Menlo Park, CA (US)

( * ) Notice: Subject to any disclaimer, the term of this patent is extended or adjusted under 35 U.S.C. 154(b) by 17 days.

(21) Appl. No.: 14/980,360

(22) Filed: Dec. 28, 2015

(65) Prior Publication Data

US 2017/0188154 A1 Jun. 29, 2017

(51) Int. Cl.

| | |
|---|---|
| ***H04R 5/033*** | (2006.01) |
| ***H04S 7/00*** | (2006.01) |
| ***H04R 29/00*** | (2006.01) |
| *H04R 17/00* | (2006.01) |

(52) U.S. Cl.

CPC ..... *H04R 5/033* (2013.01); *H04R 29/001* (2013.01); *H04S 7/304* (2013.01); *H04R 17/00* (2013.01); *H04R 2460/13* (2013.01); *H04S 2420/01* (2013.01)

(58) Field of Classification Search

None

See application file for complete search history.

(56) References Cited

U.S. PATENT DOCUMENTS 5,373,857 A * 12/1994 Travers ..... G01C 17/30 600/595
2015/0055937 A1* 2/2015 Van Hoff ..... H04N 13/0014 386/285
2017/0105074 A1* 4/2017 Jensen ..... H04R 25/407

* cited by examiner

*Primary Examiner* — Paul Huber
(74) *Attorney, Agent, or Firm* — Fenwick & West LLP

(57) ABSTRACT

An audio system, such as an audio system included in a virtual reality system, includes multiple bone transducers contacting portions of a user's head. Each bone transducer is a device, such as a piezoelectric device, that vibrates to induce vibration of bones in the user's head contacting a bone transducer. Vibration of the bone transducers mimic vibration of the bones in the user's head caused by acoustic waves contacting the user's head. During an initial calibration process, one or more models for generating control signals to vibrate the bone transducers are determined by capturing vibrations of bones in the user's head caused by audio data having different frequencies, amplitudes, phase variations, and originating from different positions relative to the user's head.

21 Claims, 4 Drawing Sheets

USING BONE TRANSDUCERS TO IMPLY POSITIONING OF AUDIO DATA RELATIVE TO A USER

BACKGROUND

The present disclosure generally relates to virtual reality (VR) system environments, and specifically to localizing a source of sounds to a user of the VR system.

Virtual reality (VR) systems typically provide multiple forms of sensory output, such as audio data and video data that operate together to create the illusion that a user is immersed in a virtual world. Conventional VR systems include headphones or another audio system to provide audio data to a user. However, when audio data is provided via headphones, users may have difficulty determining a source of certain sounds relative to the user's head. For example, with audio data presented through headphones, many users are unable to distinguish whether the audio data is intended to originate from a source behind the user or in front of the user. This may limit the realism of a virtual world provided to the user by a VR system, which may reduce interaction with the VR system by the user.

SUMMARY

A virtual reality (VR) system environment presents audio and video data to a user, providing the user with a virtual environment. The VR system environment includes a headset, or a head mounted display (HMD) providing video or image data to the user and includes headphones or another device providing audio data to the user.

Audio Data Provided by the VR System Environment

To allow the user to better distinguish a source of audio data, the VR system environment includes a set of bone transducers positioned in locations of the user's head. The bone transducers may be included in headphones provided by the VR system environment or may be components of the headset. For example, the VR system includes three bone transducers contacting portions of a left side of the user's head and another three bone transducers contacting portions of a right side of the user's head. When audio data presented to the user by the VR system environment represents a source behind the user's head, the VR system environment provides one or more control signals to the bond transducers causing one or more of the bone transducers to vibrate, which mimics vibrational sound waves hitting portions of the user's head when a sound source is behind the user. Hence, vibrating one or more of the bone transducers allows the VR system environment to more realistically provide audio data simulating sources behind the user.

The VR system environment calibrates the bone transducers through a calibration process to account for different physiologies of different users. During the calibration process, an external speaker is placed at a particular distance and location relative to the user's head and plays audio data having various frequencies within a range of frequencies and different amplitudes within a range of amplitudes. In some embodiments, the audio data also includes various phase variations between portions of the user's head. For example, the external speaker plays audio data including multiple frequencies audible to humans. While the external speaker plays the audio data, the user's head is repositioned relative to the speaker, and vibrations of bones in the user's head in response to the audio data are captured by the bone transducers. In various embodiments, the VR headset presents instructions to the user for modifying positioning of the user's head relative to the external speaker. For example, the VR headset presents instructions to the user to modify an angle between a reference point on the user's head and an axis of the external speaker, so the different positions of the user's head relative to the external speaker correspond to different angles between the reference point of the user's head and the axis of the speaker, so the bone transducers capture information describing vibration of bones in the user's head corresponding to different frequencies, different amplitudes, different phase variations between locations on the user's head, and different positions of the user's head relative to the external speaker.

Based on the information describing vibration of bones in the user's head corresponding to the different frequencies, different amplitudes, and different positions of the user's head, as well as the particular distance between the external speaker and the user's head, the VR system generates one or more models to generate instructions for one or more bone transducers to vibrate bones in the user's skull to replicate audio data having different amplitudes, frequencies, and positions relative to the user's head. In various embodiments, a component of the VR system, such as a VR console, applies one or more machine learned models to the information describing vibration of bones in the user's head corresponding to the different frequencies, different amplitudes, different phase variations between locations on the user's head, different positions of the user's head, and the particular distance between the external speaker and the user's head. For example, to generate audio data from a source relative to the user's head, the model generates control signals for one or more bone transducers based on a specific frequency, a specific amplitude, a specific distance, and a specific angle between a reference point of the user's head and an axis of a source of the audio data. Based on the control signals, different bone transducers vibrate at different frequencies, causing bones in the user's skull to vibrate.

In some embodiments, the VR system environment further calibrates the generated one or more models by playing audio data associated with a specific position relative to the user's head (e.g., relative to a reference point of the user's head) for the user. Using the generated one or more models, the VR system environment generates control signals communicated to the one or more bone transducers, causing the one or more bone transducers to vibrate accordingly. The VR headset prompts the user to identify a position of audio data relative to the user's head based on the user's perception from vibrations of bones in the user's head induced by the bone transducers. The VR system environment determines a difference between the specific position associated with the played audio data and position of the audio data relative to the user's head identified by the user. Based on the determined difference, the VR system environment modifies the one or more models to minimize differences between identified locations of audio data and specific locations associated with played audio data.

The figures depict embodiments of the present disclosure for purposes of illustration only. One skilled in the art will readily recognize from the following description that alternative embodiments of the structures and methods illustrated herein may be employed without departing from the principles of the disclosure described herein.

DETAILED DESCRIPTION

System Overview

Figure 1:
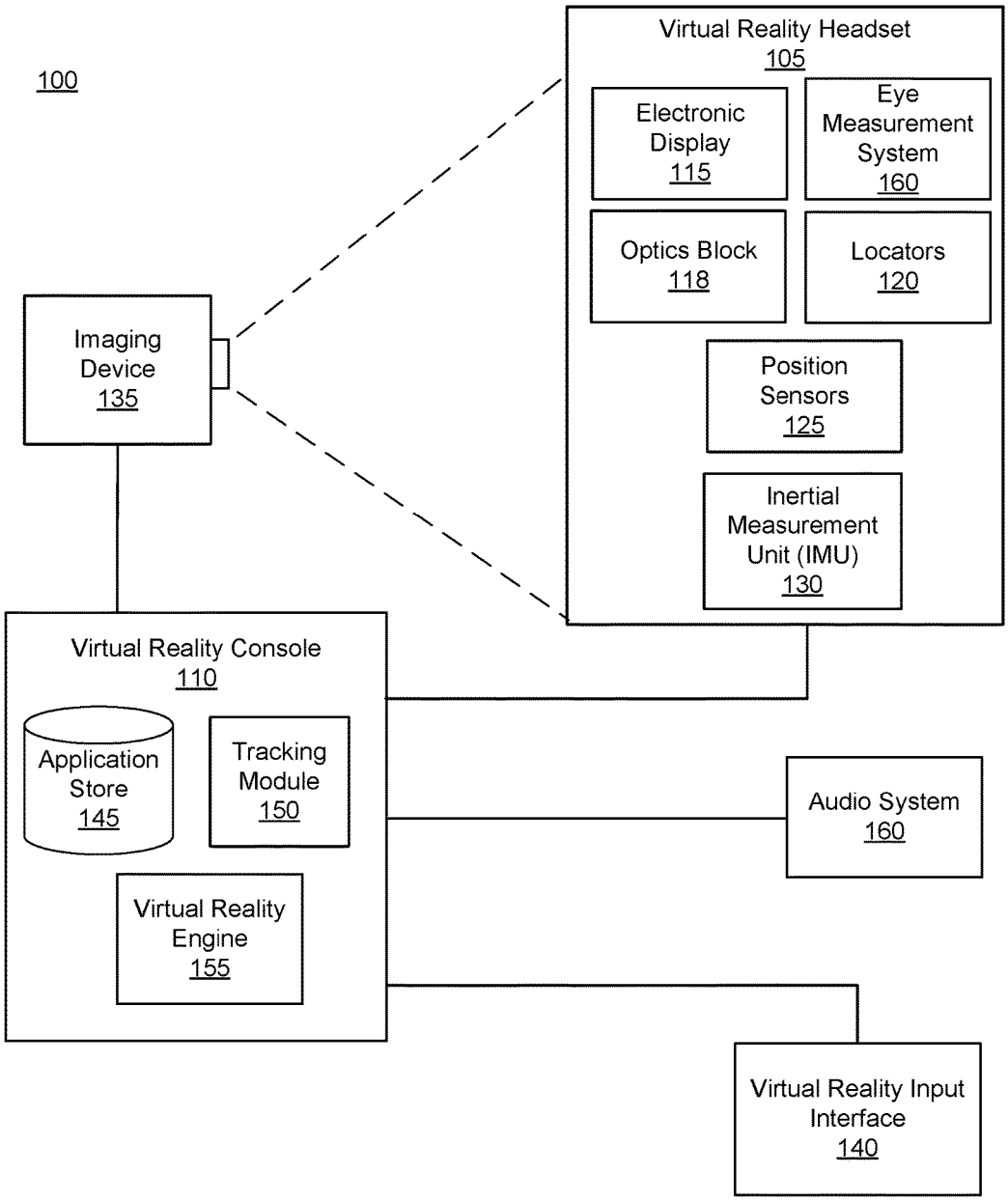
FIG. 1 is a block diagram of a system environment including a virtual reality system environment, in accordance with an embodiment.

FIG. 1 is a block diagram of a virtual reality (VR) system environment 100 in which a VR console 110 operates. The system environment 100 shown by FIG. 1 comprises a VR headset 105, an imaging device 135, a VR input interface 140, and an audio system 160 that are each coupled to the VR console 110. While FIG. 1 shows an example system 100 including one VR headset 105, one imaging device 135, and one VR input interface 140, in other embodiments any number of these components may be included in the system 100. For example, there may be multiple VR headsets 105 each having an associated VR input interface 140 and audio system 160 being monitored by one or more imaging devices 135, with each VR headset 105, VR input interface 140, imaging device 135 and audio system 160 communicating with the VR console 110. In alternative configurations, different and/or additional components may be included in the VR system environment 100. Additionally, the VR system environment 100 described herein may be an augmented reality system that presents a user with a combination of virtual content and content from an environment surrounding the user.

The VR headset 105 is a head-mounted display (HMD) that presents media to a user. Examples of media presented by the VR head set include one or more images, video, audio, or some combination thereof. In some embodiments, audio is presented via an audio system 160, which is further described below, that receives audio information from the VR headset 105, the VR console 110, or both, and presents audio data based on the audio information. An embodiment of the VR headset 105 is further described below in conjunction with FIG. 2. The VR headset 105 may comprise one or more rigid bodies, which may be rigidly or non-rigidly coupled to each other together. A rigid coupling between rigid bodies causes the coupled rigid bodies to act as a single rigid entity. In contrast, a non-rigid coupling between rigid bodies allows the rigid bodies to move relative to each other.

The VR headset 105 includes an electronic display 115, an optics block 118, one or more locators 120, one or more position sensors 125, an inertial measurement unit (IMU) 130, and an eye measurement system 160. The electronic display 115 displays images to the user in accordance with data received from the VR console 110. In various embodiments, the electronic display 115 may comprise a single electronic display or multiple electronic displays (e.g., a display for each eye of a user). Examples of the electronic display 115 include: a liquid crystal display (LCD), an organic light emitting diode (OLED) display, an active-matrix organic light-emitting diode display (AMOLED), some other display, or some combination thereof.

The optics block 118 magnifies received light, corrects optical errors associated with the image light, and presents the corrected image light is presented to a user of the VR headset 105. An optical element may be an aperture, a Fresnel lens, a convex lens, a concave lens, a filter, or any other suitable optical element that affects the blurred image light. Moreover, the optics block 118 may include combinations of different optical elements. In some embodiments, one or more of the optical elements in the optics block 118 may have one or more coatings, such as anti-reflective coatings.

Magnification of the image light by the optics block 118 allows the electronic display 115 to be physically smaller, weigh less, and consume less power than larger displays. Additionally, magnification may increase a field of view of the displayed media. For example, the field of view of the displayed media is such that the displayed media is presented using almost all (e.g., 110 degrees diagonal), and in some cases all, of the user's field of view. Additionally, the optics block 118 may be designed so its effective focal length is larger than the spacing to the electronic display 115, which magnifies the image light projected by the electronic display 115. Additionally, in some embodiments, the amount of magnification may be adjusted by adding or removing optical elements.

The optics block 118 may be designed to correct one or more types of optical error. Examples of optical error include: barrel distortion, pincushion distortion, longitudinal chromatic aberration, transverse chromatic aberration, other types of two-dimensional optical error spherical aberration, comatic aberration, field curvature, astigmatism, or any other type of three-dimensional optical error. In some embodiments, content provided to the electronic display 115 for display is pre-distorted, and the optics block 118 corrects the distortion when is receives image light from the electronic display 115 generated based on the content.

The locators 120 are objects located in specific positions on the VR headset 105 relative to one another and relative to a specific reference point on the VR headset 105. A locator 120 may be a light emitting diode (LED), a corner cube reflector, a reflective marker, a type of light source that contrasts with an environment in which the VR headset 105 operates, or some combination thereof. In embodiments where the locators 120 are active (i.e., an LED or other type of light emitting device), the locators 120 may emit light in the visible band (~380 nm to 750 nm), in the infrared (IR) band (~750 nm to 1 mm), in the ultraviolet band (10 nm to 380 nm), some other portion of the electromagnetic spectrum, or some combination thereof.

In some embodiments, the locators 120 are located beneath an outer surface of the VR headset 105, which is transparent to the wavelengths of light emitted or reflected by the locators 120 or is thin enough to not substantially attenuate the wavelengths of light emitted or reflected by the locators 120. Additionally, in some embodiments, the outer surface or other portions of the VR headset 105 are opaque in the visible band of wavelengths of light. Thus, the locators 120 may emit light in the IR band under an outer surface that is transparent in the IR band but opaque in the visible band.

The IMU 130 is an electronic device that generates fast calibration data based on measurement signals received from one or more of the position sensors 125. A position sensor 125 generates one or more measurement signals in response to motion of the VR headset 105. Examples of position sensors 125 include: one or more accelerometers, one or more gyroscopes, one or more magnetometers, another suitable type of sensor that detects motion, a type of sensor used for error correction of the IMU 130, or some combination thereof. The position sensors 125 may be located external to the IMU 130, internal to the IMU 130, or some combination thereof.

Based on the one or more measurement signals from one or more position sensors 125, the IMU 130 generates fast calibration data indicating an estimated position of the VR headset 105 relative to an initial position of the VR headset 105. For example, the position sensors 125 include multiple accelerometers to measure translational motion (forward/back, up/down, left/right) and multiple gyroscopes to measure rotational motion (e.g., pitch, yaw, roll). In some embodiments, the IMU 130 rapidly samples the measurement signals and calculates the estimated position of the VR headset 105 from the sampled data. For example, the IMU 130 integrates the measurement signals received from the accelerometers over time to estimate a velocity vector and integrates the velocity vector over time to determine an estimated position of a reference point on the VR headset 105. Alternatively, the IMU 130 provides the sampled measurement signals to the VR console 110, which determines the fast calibration data. The reference point is a point that may be used to describe the position of the VR headset 105. While the reference point may generally be defined as a point in space; however, in practice the reference point is defined as a point within the VR headset 105 (e.g., a center of the IMU 130).

The IMU 130 receives one or more calibration parameters from the VR console 110. As further discussed below, the one or more calibration parameters are used to maintain tracking of the VR headset 105. Based on a received calibration parameter, the IMU 130 may adjust one or more IMU parameters (e.g., sample rate). In some embodiments, certain calibration parameters cause the IMU 130 to update an initial position of the reference point so it corresponds to a next calibrated position of the reference point. Updating the initial position of the reference point as the next calibrated position of the reference point helps reduce accumulated error associated with the determined estimated position. The accumulated error, also referred to as drift error, causes the estimated position of the reference point to "drift" away from the actual position of the reference point over time.

The imaging device 135 generates slow calibration data in accordance with calibration parameters received from the VR console 110. Slow calibration data includes one or more images showing observed positions of the locators 120 that are detectable by the imaging device 135. The imaging device 135 may include one or more cameras, one or more video cameras, any other device capable of capturing images including one or more of the locators 120, or some combination thereof. Additionally, the imaging device 135 may include one or more filters (e.g., used to increase signal to noise ratio). The imaging device 135 is configured to detect light emitted or reflected from locators 120 in a field of view of the imaging device 135. In embodiments where the locators 120 include passive elements (e.g., a retroreflector), the imaging device 135 may include a light source that illuminates some or all of the locators 120, which retroreflect the light towards the light source in the imaging device 135. Slow calibration data is communicated from the imaging device 135 to the VR console 110, and the imaging device 135 receives one or more calibration parameters from the VR console 110 to adjust one or more imaging parameters (e.g., focal length, focus, frame rate, ISO, sensor temperature, shutter speed, aperture, etc.).

The VR input interface 140 is a device that allows a user to send action requests to the VR console 110. An action request is a request to perform a particular action. For example, an action request may be to start or end an application or to perform a particular action within the application. The VR input interface 140 may include one or more input devices. Example input devices include: a keyboard, a mouse, a game controller, or any other suitable device for receiving action requests and communicating the received action requests to the VR console 110. An action request received by the VR input interface 140 is communicated to the VR console 110, which performs an action corresponding to the action request. In some embodiments, the VR input interface 140 may provide haptic feedback to the user in accordance with instructions received from the VR console 110. For example, haptic feedback is provided when an action request is received, or the VR console 110 communicates instructions to the VR input interface 140 causing the VR input interface 140 to generate haptic feedback when the VR console 110 performs an action.

The VR console 110 provides media to the VR headset 105 for presentation to the user in accordance with information received from one or more of: the imaging device 135, the VR headset 105, and the VR input interface 140. In the example shown in FIG. 1, the VR console 110 includes an application store 145, a tracking module 150, and a virtual reality (VR) engine 155. Some embodiments of the VR console 110 have different modules than those described in conjunction with FIG. 1. Similarly, the functions further described below may be distributed among components of the VR console 110 in a different manner than is described here.

The application store 145 stores one or more applications for execution by the VR console 110. An application is a group of instructions, that when executed by a processor, generates content for presentation to the user. Content generated by an application may be in response to inputs received from the user via movement of the HR headset 105 or the VR interface device 140. Examples of applications include: gaming applications, conferencing applications, video playback application, or other suitable applications.

The tracking module 150 calibrates the VR system environment 100 using one or more calibration parameters and may adjust one or more calibration parameters to reduce error in determination of the position of the VR headset 105. For example, the tracking module 150 adjusts the focus of the imaging device 135 to obtain a more accurate position for observed locators on the VR headset 105. Moreover, calibration performed by the tracking module 150 also accounts for information received from the IMU 130. Additionally, if tracking of the VR headset 105 is lost (e.g., the imaging device 135 loses line of sight of at least a threshold number of the locators 120), the tracking module 140 re-calibrates some or all of the VR system environment 100.

The tracking module 150 tracks movements of the VR headset 105 using slow calibration information from the imaging device 135. The tracking module 150 determines positions of a reference point of the VR headset 105 using observed locators from the slow calibration information and a model of the VR headset 105. The tracking module 150 also determines positions of a reference point of the VR headset 105 using position information from the fast calibration information. Additionally, in some embodiments, the tracking module 150 may use portions of the fast calibration information, the slow calibration information, or some combination thereof, to predict a future location of the headset 105. The tracking module 150 provides the estimated or predicted future position of the VR headset 105 to the VR engine 155.

The VR engine 155 executes applications within the system environment 100 and receives position information, acceleration information, velocity information, predicted future positions, or some combination thereof of the VR headset 105 from the tracking module 150. Based on the received information, the VR engine 155 determines content to provide to the VR headset 105 for presentation to the user. For example, if the received information indicates that the user has looked to the left, the VR engine 155 generates content for the VR headset 105 that mirrors the user's movement in a virtual environment. Additionally, the VR engine 155 performs an action within an application executing on the VR console 110 in response to an action request received from the VR input interface 140 and provides feedback to the user that the action was performed. The provided feedback may be visual or audible feedback via the VR headset 105 or haptic feedback via the VR input interface 140.

The audio system 160 receives audio information from the VR console 110, from the VR headset 105, or from both, and presents audio data to a user based on the audio information. For example, the audio system 160 comprises headphones coupled to or included in the VR headset 105 that are positioned proximate to the user's ears and present audio data. In some embodiments, the audio system 160 includes one or more speakers coupled to the VR console 110 or to the VR headset 105 and playing audio data to the user. The VR console 110 or the VR headset 105 may provide audio data perceived by the user as originating from sources at various positions relative to the user's head to provide a realistic virtual environment to the user. However, users have difficulty distinguishing audio data from the audio system 160 to be perceived as originating from certain positions relative to the user's head. For example, many users are unable to accurately distinguish between perceived sources of audio data in certain positions in front of the user's head or in certain positions behind the user's head.

To allow the user to better perceive sources of audio data relative the user's head presented by headphones or speakers, the audio system 160 includes a set of bone transducers, with different bone transducers contacting different positions of the user's head. For example, the audio system 160 includes six bone transducers, with three bone transducers contacting a ridge of bone between the user's left ear and skull and another three bone transducers contacting another ridge of bone between the user's right ear and skull. Example positioning of bone transducers is further described below in conjunction with FIG. 3. Each bone transducer may be a piezoelectric device that vibrates based on a control signal received from the VR console 110 or from the VR headset 105. Vibration of a bone transducer vibrates bones in the user's head contacting the bone transducer, which simulate acoustic waves contacting a user's skull from sources positioned away from the user's 'skull. The bone transducers are calibrated for the user through a calibration process, as further described below in conjunction with FIGS. 4 and 5, so the audio system 160 allows the user to more realistically perceive sources of audio data provided to the user by the VR system environment 100.

Figure 2:
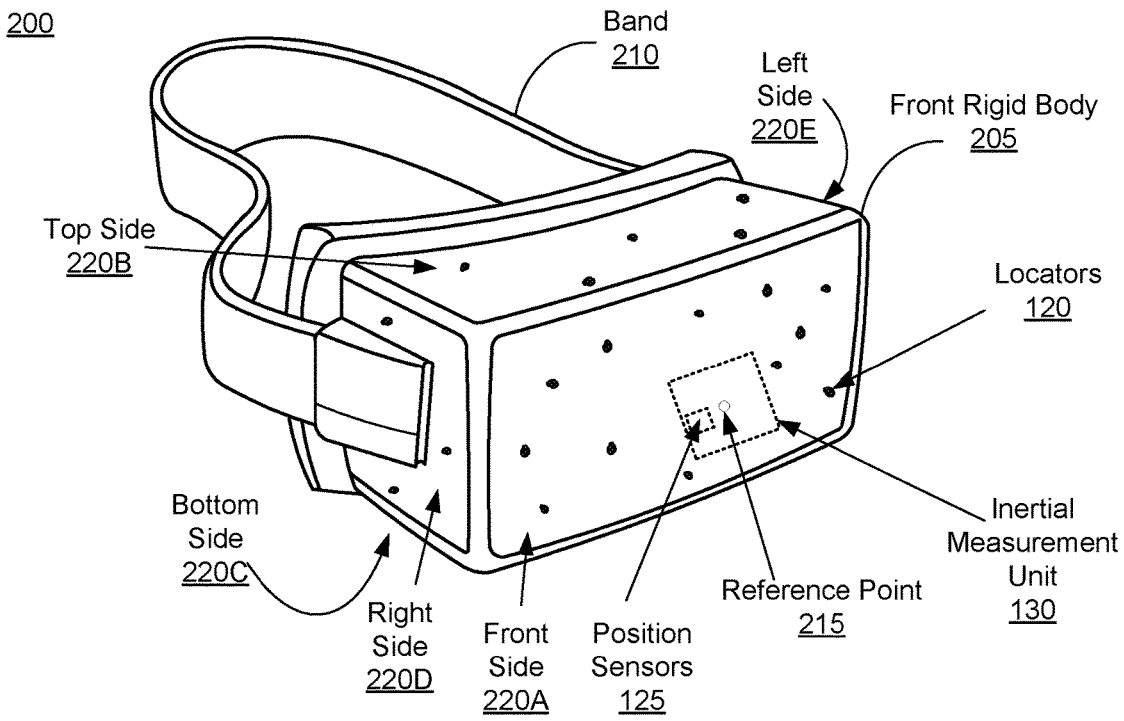
FIG. 2 is a diagram of a virtual reality headset, in accordance with an embodiment.

FIG. 2 is a diagram of one embodiment of the virtual reality (VR) headset 105. The VR headset 200 includes a front rigid body 205 and a band 210. The front rigid body 205 includes the electronic display 115 (not shown in FIG. 2), the IMU 130 (not shown in FIG. 2A), the one or more position sensors 125 (not shown in FIG. 2), and the locators 120. In other embodiments, the VR headset 200 may include different or additional components than those depicted by FIG. 2.

The locators 120 are located in fixed positions on the front rigid body 205 relative to one another and relative to a reference point. For example, the reference point is located at the center of the IMU 130. Each of the locators 120 emit light that is detectable by the external imaging device 135. Locators 120, or portions of locators 120, are located on a front side 220A, a top side 220B, a bottom side 220C, a right side 220D, and a left side 220E of the front rigid body 205 in the example of FIG. 2.

Figure 3:
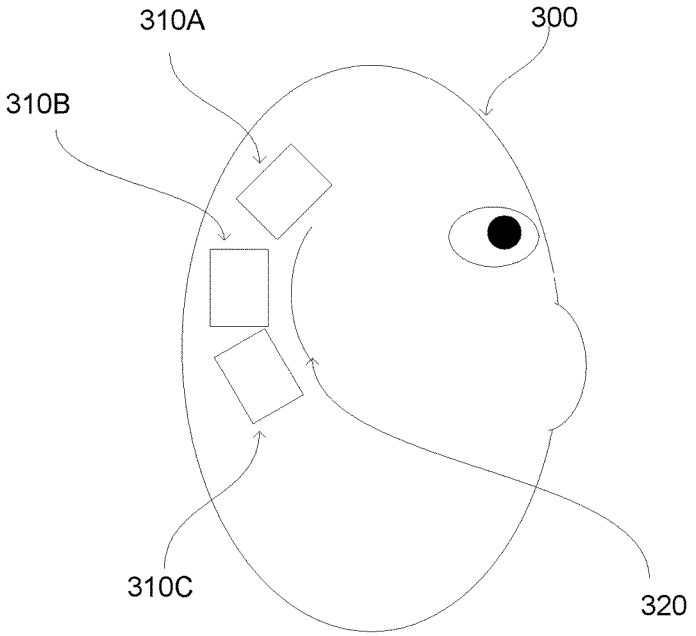
FIG. 3 is an example of bone transducers in the virtual reality system environment relative to a head of a user, in accordance with an embodiment.

FIG. 3 is an example positioning of bone transducers in an audio system 160 of a virtual reality (VR) system environment 100 on a user's head 300. For purposes of illustration, FIG. 3 shows positioning of bone transducers on one side of the user's head 300. Other bone transducers may be similarly positioned on another side of the user's head 300.

In the example of FIG. 3, three bone transducers 310A, 310B, 310C (also referred to individually and collectively using reference number 310) are positioned along a bone ridge between the user's ear 320 and the user's skull. Using any suitable mechanism, the bone transducers 310A, 310B, 310C are held in contact with the user's head. For example, a spring-backed mechanism is coupled to each bone transducer 310A, 310B, 310C applying force to the different bone transducer 310A, 310B, 310C so each bone transducer 310A, 310B, 310C contacts the users skull. While FIG. 3 shows an example where three bone transducers 310A, 310B, 310C contact the user's skull, in various embodiments, any suitable number of bone transducers 310 may contact the user's skull.

Calibrating Bone Transducers in an Audio System for a User

Figure 4:
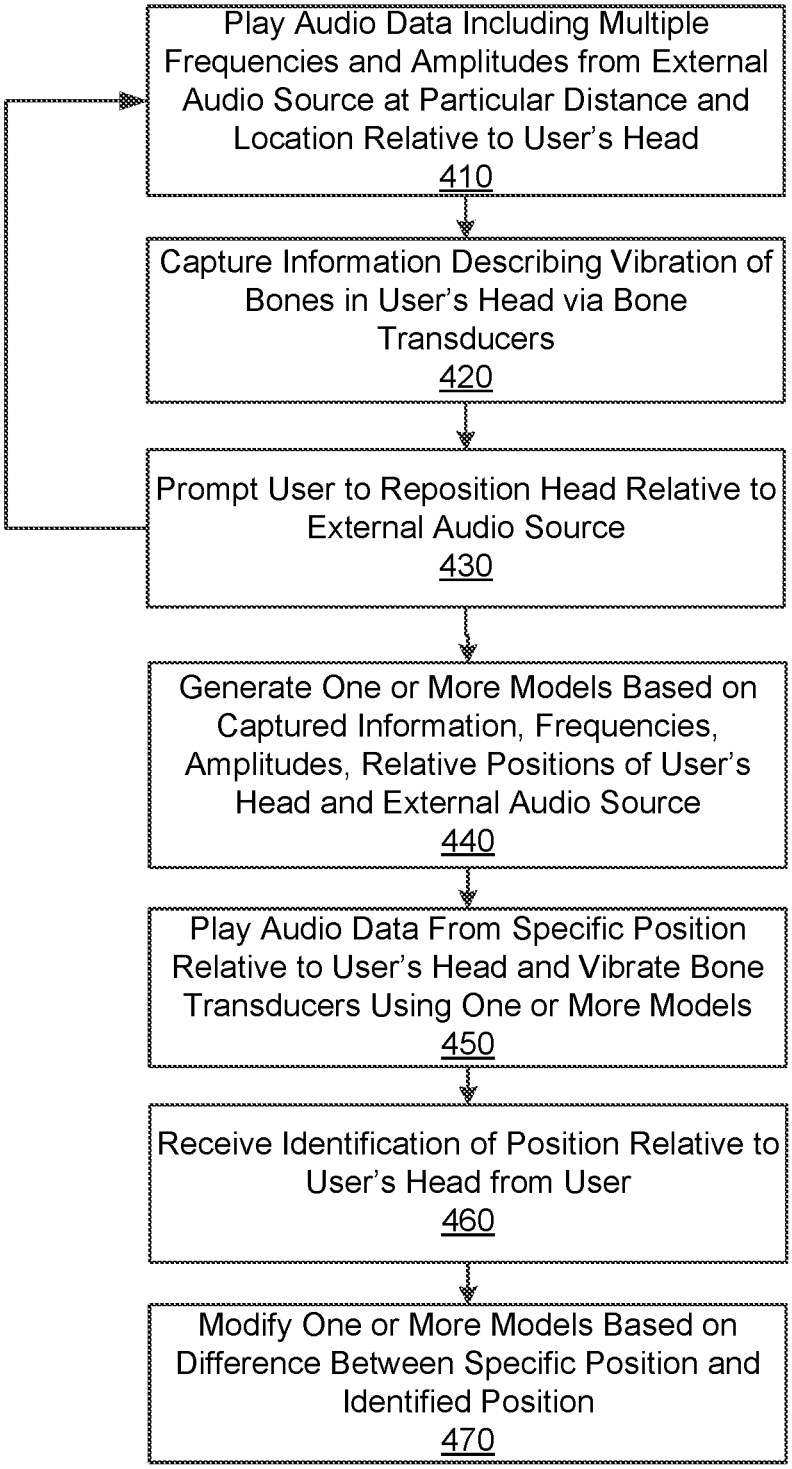
FIG. 4 is a flowchart of a method for calibrating bone transducers for vibrating bones of a user's head, in accordance with an embodiment.

FIG. 4 is a flowchart of one embodiment of a method for calibrating bone transducers 310 for vibrating bones of a user's head. In other embodiments, the method may include different or additional steps than those described in conjunction with FIG. 4. Additionally, the method may perform the steps in different orders than the order described in conjunction with FIG. 4 in various embodiments.

A system, such as a VR system environment 100, includes an audio system 160 with multiple bone transducers contacting portions of a user's head. Each bone transducer 310 is a piezoelectric device or other device that produces vibrational motion in response to a control signal. Vibration of a bone transducer 310 induces vibration in a portion of a bone of the user's skull contacting the bone transducer, with vibration of the portion of the bone simulating vibration of the bone when acoustic waves contact the portion of the bone. Including bone transducers 310 allows the user to more accurately discern a position relative to the user's head from which audio data provided by the audio system 160 is to be perceived as originating.

For the bone transducers to accurately vibrate so the user perceives vibration from the bone transducers 310 similar to vibrations caused by acoustic waves, the bone transducers are initially calibrated. In various embodiments, an audio source external to the audio system 160 (i.e., an "external audio source"), such as a speaker, is placed at a particular distance and location relative to the user's head and plays 410 audio data including multiple frequencies within a range of frequencies and different amplitudes within a range of amplitudes or including multiple phase variations between locations on the user's head (e.g., locations on the user's head where the bone transducers 310 are positioned) within a range of phase variations. If the audio system 160 comprises headphones and the bone transducers 310, the external audio source may be a speaker at the particular distance and location relative to the user's head, such as 4 feet in front of the user's head. Audio data played 410 by the external audio sources includes multiple frequencies between 20 Hertz and 22 kilohertz and various amplitudes.

As the external audio source plays 410 the audio data, acoustic waves from the audio data contact the user's head, causing vibration of bones in the user's skull. The bone transducers 310 contacting the user's head capture 420 information describing vibration of portions of bones contacting the bone transducers 310. In various embodiments, the external audio source plays 410 audio data having a specific frequency and a specific amplitude during a time interval, so information captured 420 by the bone transducers 310 during the time interval describes vibration of portions of bones in the user's skull caused by acoustic waves having the specific frequency and the specific amplitude. Different frequencies and amplitudes may be associated with different time intervals, so information captured 420 by the bone transducers 310 during a time interval corresponds to a frequency and an amplitude of the audio data during the time interval. In some embodiments, the information captured 420 by a bone transducer 310 identifies a frequency and an amplitude with which portions of bones in the user's skull contacting the bone transducer 310 vibrates.

The audio system 160, or the VR system environment 100, prompts 430 the user to reposition the user's head relative to the external audio source. In some embodiments, the user is prompted 430 to reposition the user's head after the audio data has been played 410 by the external audio source. Alternatively, the user is prompted 430 to reposition the user's head while the audio data is played 410 by the external audio source. If the audio system 160 is included in a VR system environment 100, a VR headset 105 in the VR system environment 100 may present instructions prompting 430 the user on how to reposition the user's head.

In various embodiments, instructions presented the user to reposition the user's head relative to the external audio source prompt 430 the user to modify an angle between a reference point (e.g., a user's ear, a user's eye, a nose, or another point on the user's head) on the user's head and an axis of the external audio source, such an axis passing through a center of the external audio source or another point of the external audio source. Hence, different positions of the user's head relative to the external audio source correspond to different angles between the reference point of the user's head and the axis of the speaker. The external audio source plays 410 the audio data and the bone transducers 310 capture 420 information describing vibration of portions of bones contacting the bone transducers 310 when the user's head is repositioned relative to the external audio source. Hence, the bone transducers 310 capture information describing vibration of bones in the user's skull caused by different frequencies and different amplitudes of the audio while the user's head has different orientations relative to the external audio source (e.g., different angles between the reference point on the user's head and the axis of the external audio source). The audio system 160 may prompt 430 to reposition the user's head relative to the external audio source multiple times so the bone transducers 310 capture 420 information describing vibration of bones in the user's skull caused by different frequencies, different amplitudes, or different phase variations between locations on the user's head of audio data at multiple specific positions of the user's head relative to the external audio source.

Figure 5:
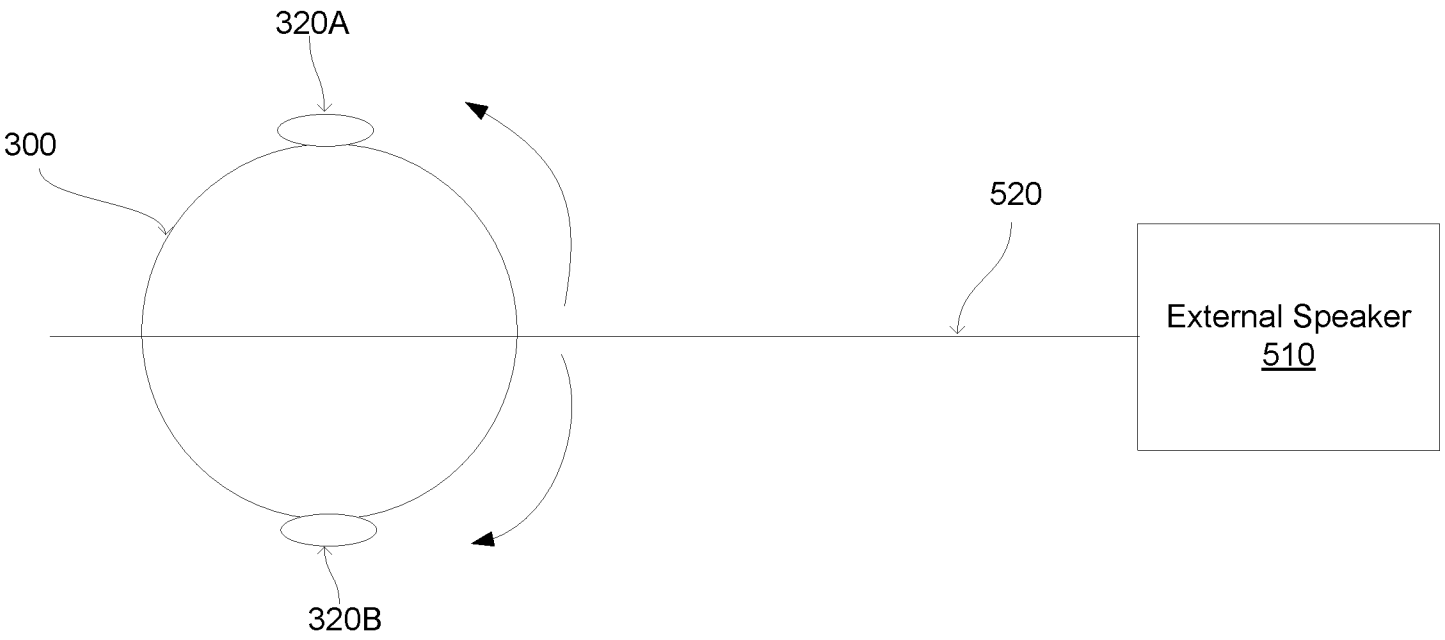
FIG. 5 is a diagram of positioning a user's head relative to an external audio source to calibrate bone transducers, in accordance with an embodiment.

FIG. 5 is a conceptual diagram of an example positioning a user's head relative to an external audio source to calibrate bone transducers 310. In the example of FIG. 5, the user's head 300 is a particular distance from an external speaker 520 and positioned so an axis 520 of the external speaker 510, such as an axis passing through a center of the external speaker 510 also passes through a point on the user's head 300. As described above in conjunction with FIG. 4, the external speaker 510 plays audio data causing vibration in various bones in the user's head and bone transducers 310 contacting various bones in the user's head capture information describing the vibration.

The user is prompted to reposition the user's head 300 relative to the external speaker 510 so the bone transducers 310 may capture information describing vibration of bones in the user's head when the user's head 300 has different positions relative to the external speaker 510. For example, the user is prompted to reposition the user's head 300 so an ear of the user 320A is nearer to the axis 520 of the external speaker 510 than when the external speaker 510 initially plays the audio data and is subsequently prompted to reposition the user's head 300 so another ear of the user 320B is nearer to the axis of the external speaker 510 than when the external speaker 510 previously played audio data. Hence, in the example of FIG. 4, the bone transducers 310 capture information describing vibration of bones in the user's head 300 at different positions relative to the external speaker 510.

Referring back to FIG. 4, based on captured information describing vibration of bones in the user's head corresponding to different frequencies and different amplitudes of the audio data played 410 by the external audio source while the user's head has different positions relative to the external audio source, the audio system 160 generates 440 one or more models for the bone transducers 310. The particular distance between the external audio source and the user's head is also used to when generating 440 the one or more models. In various embodiments, a processor included in the audio system 160 or in the VR console 110 generates 440 the one or more models. Different models may be associated with different bone transducers 310 in some embodiments. Alternatively, a model may be associated with multiple bone transducers 310 to provide control signals or instructions to multiple bone transducers 310. For example, if the audio system 160 includes six bone transducers 310, six models are generated 440, with each model associated with a different bone transducer 310. A model for a bone transducer 310 generates instructions or control signals that, when received by the bone transducer 310, cause the bone transducer 310 to vibrate, causing one or more portions of a bone in the user's skull contacting the bone transducer 310 to vibrate. Hence, the model for the bone transducer 310 allows the bone transducer 310 to vibrate portions of a bone in the user's skull contacting the bone transducer 310 to simulate vibration of the bone in the user's skull from audio waves from audio data having different amplitudes, frequencies, and positions relative to the user's head contacting the user's head. The audio system 310 may apply one or more machine learned models to the captured 420 information describing vibration of the bones in the user's skull when different frequencies, different amplitudes, or different phase variations between locations on the user's head of the audio data are played 410 while the user's head has different positions relative to the external audio source.

In various embodiments, the audio system 160 stores the generated one or more models in a storage device, such as a memory, in association with an identifier of the user.

Alternatively, the VR console 110 stores the generated one or more models in association with the identifier of the user in a storage device. When the audio system 160 plays audio data after storing the generated one or more models, the audio system 160 uses the one or more models to generate control signals or instructions for one or more of the bone transducers 310 based on frequencies, amplitudes, and a position of a source of the audio data relative to the user's head. The audio system 160 communicates the generated control signals or instructions to one or more bone transducers 310, which vibrate based on the control signals or instructions, causing portions of bones in the user's skull contracting the bone transducers 310. For example, to generate audio data from a source relative to the user's head, the model generates control signals for one or more bone transducers 310 based on a specific frequency, a specific amplitude, a specific distance, a specific phase variation between locations on the user's head (e.g., locations on the user's head where different bone transducers 310 are located), and a specific angle between a reference point of the user's head and an axis of a referee point of a source of the audio data. Based on the control signals, different bone transducers 310 vibrate at different frequencies, causing bones in the user's skull contacting the bone transducers 310 to vibrate.

In some embodiments, the generated one or more models are further calibrated by the audio system 160 generating audio data associated with a specific position relative to the user's head (e.g., relative to a reference point of the user's head) and using the generated one or more models to generate control signals or instructions for the one or more bone transducers 310. The audio system 160 plays 450 the audio data and communicates the control signals or instructions to the one or more bone transducers 310 to vibrate the bone transducers 310. When the audio data is played 450 by the audio system 160 and the bone transducers 310 vibrate, the user is prompted to identify a position of the audio data relative to the user's head. For example, if the audio system 160 is included in a VR system environment 110, the VR headset 105 prompts the user to identify a position of the generated audio data relative to the user's head based on the user's perception from vibrations of bones in the user's head induced by the bone transducers 310 and the played 450 audio data. In an example, the VR headset 105 prompts the user to point to a position where the user perceives the audio data originates, and the user identifies the position using the VR input interface 140.

When the audio system 160 receives 460 identification of the position where the user perceives the played audio data originates, the audio system 160 modifies 470 one or more of the models based the position identified by the user and the specific position associated with the audio data. In various embodiments, the audio system 160 determines a difference between the specific location associated with the audio data and the position of the audio data identified by the user. Based on the determined difference, the audio system 160 modifies the one or more models to reduce or to minimize the difference between the specific location associated with the audio data and the position of the audio data identified by the user. The audio system 160 may maintain stored adjustments corresponding to differences between specific locations associated with the audio data and identified position of the audio data and modify 470 a model based on a stored adjustment corresponding to the determine differences between the specific location associated with the audio data and the position of the audio data identified by the user. Alternatively, the audio system 160 modifies 470 one or more model themselves based on the difference between the specific location associated with the audio data and the position of the audio data identified by the user. Modifying the one or more models to reduce the difference between the specific location associated with the audio data and the position of the audio data identified by the user allows the one or more models to induce vibration by the bone transducers 310 to more accurately simulate positions of audio data relative to the user's head. In some embodiments, the audio system 160 modifies 470 the one or more models as audio data is presented to the user based on differences between positions associated with audio data played 450 by the audio system 160 and positions identified by user inputs when the audio data is played. The audio system 160 subsequently stores the modified one or more models in association with the user for subsequent use when playing additional audio data to the user.

Using the stored one or more models, or the stored one or more modified models, the audio system 160 generates one or more control signals for the one or more bone transducers 310 based on additional audio data for presentation to the user. For example, the audio system 160 identifies amplitudes, frequencies, or phase variations between locations on the user's head of audio data included in information providing a virtual environment to the users, as well as positions of the audio data relative to the user's head and generates control signals for various bone transducers 310 using the identified amplitudes, frequencies, or phase variations between locations on the user's head of audio data included in information providing a virtual environment to the users and positions of the audio data relative to the user's head as inputs to the one or more models. The audio system 160 plays the audio data while providing the generated one or more control signals to the bone transducers 310, causing the bone transducers 310 to vibrate based on the control signals as the audio data is played. Vibration of the bone transducers 310 induce vibration of portions of bones in the user's head in contact with the bone transducers 310, allowing the audio system 160 to better simulate audio data originating from various positions relative to the user's head.

Additional Configuration Information

The foregoing description of the embodiments has been presented for the purpose of illustration; it is not intended to be exhaustive or to limit the patent rights to the precise forms disclosed. Persons skilled in the relevant art can appreciate that many modifications and variations are possible in light of the above disclosure.

The language used in the specification has been principally selected for readability and instructional purposes, and it may not have been selected to delineate or circumscribe the inventive subject matter. It is therefore intended that the scope of the patent rights be limited not by this detailed description, but rather by any claims that issue on an application based hereon. Accordingly, the disclosure of the embodiments is intended to be illustrative, but not limiting, of the scope of the patent rights, which is set forth in the following claims.

What is claimed is:

1. A method comprising:

playing audio data including a plurality of frequencies and a plurality of amplitudes from an audio source external to an audio system worn by a user, the audio source a particular distance from a head of the user and the audio system including a plurality of bone transducers contacting portions of bones in the user's head;

capturing information describing vibration of portions of bones in the user's head caused by the frequencies and amplitudes included in the audio data using the bone transducers in the audio system;

prompting the user to modify a position the user's head relative to the audio source external to the audio system;

capturing information describing vibration of portions of bones in the user's head caused by the frequencies and amplitudes included in the audio data using the bone transducers in the audio system for multiple positions of the user's head relative to the audio source external to the audio system; and generating one or more models associated with the bone transducers based on captured information describing vibration of portions of bones in the user's head caused by the frequencies and amplitudes included in the audio data, frequencies included in the audio data, amplitudes included in the audio data, positions of the user's head relative to the audio data, and the particular distance from the audio source external to the audio system to the user's head.

2. The method of claim 1, further comprising:

storing the generated one or more models in association with the user.

3. The method of claim 1, further comprising:

playing audio data associated with a specific position relative to the user's head via the audio system;

receiving an identified position of the played audio data relative to the user's head from the user; and modifying one or more of the generated models based at least in part on the specific position associated with the played audio data and the identified position of the played audio data received from the user.

4. The method of claim 3, wherein modifying one or more of the generated models based at least in part on the specific position associated with the played audio data and the identified position of the played audio data received from the user comprises:

determining a difference between the specific position and the identified position; and modifying one or more of the generated models to minimize the determined difference.

5. The method of claim 3, further comprising:

storing the modified one or more generated models in association with the user.

6. The method of claim 1, wherein prompting the user to modify the position the user's head relative to the audio source external to the audio system comprises:

prompting the user to modify an angle between a reference point on the user's head and an axis of the audio source external to the audio system.

7. The method of claim 1, wherein playing audio data including the plurality of frequencies and the plurality of amplitudes from the audio source external to the audio system worn by the user comprises:

playing audio data including multiple time intervals, each time interval including audio data having a different amplitude and different frequency.

8. The method of claim 7, wherein capturing information describing vibration of portions of bones in the user's head caused by the frequencies and amplitudes included in the audio data using the bone transducers in the audio system comprises:

capturing information describing vibration of portions of bones in the user's head during a time interval; and associating the captured information during the time interval with a frequency and an amplitude of the audio data during the time interval.

9. The method of claim 1, further comprising:

generating one or more control signals for the one or more bone transducers based on additional audio data, a control signal for a bone transducer describing vibration of the bone transducer; and playing the additional audio data for the user via the audio system while providing the one or more control signals to the one or more bone transducers in the audio system.

10. The method of claim 1, wherein the audio system is included in a virtual reality system including a virtual reality headset.

11. The method of claim 10, wherein prompting the user to modify the position the user's head relative to the audio source external to the audio system comprises:

presenting instructions for repositioning the user's head relative to the audio source via the virtual reality headset.

12. A computer program product comprising a non-transitory computer readable medium having instructions encoded thereon that, when executed by a processor, cause the processor to:

play audio data including a plurality of frequencies and a plurality of amplitudes from an audio source external to an audio system worn by a user, the audio source a particular distance from a head of the user and the audio system including a plurality of bone transducers contacting portions of bones in the user's head;

capture information describing vibration of portions of bones in the user's head caused by the frequencies and amplitudes included in the audio data using the bone transducers in the audio system;

prompt the user to modify a position the user's head relative to the audio source external to the audio system;

capture information describing vibration of portions of bones in the user's head caused by the frequencies and amplitudes included in the audio data using the bone transducers in the audio system for multiple positions of the user's head relative to the audio source external to the audio system; and generate one or more models associated with the bone transducers based on captured information describing vibration of portions of bones in the user's head caused by the frequencies and amplitudes included in the audio data, frequencies included in the audio data, amplitudes included in the audio data, positions of the user's head relative to the audio data, and the particular distance from the audio source external to the audio system to the user's head.

13. The computer program product of claim 11, wherein the computer readable storage medium further has instructions encoded thereon that, when executed by the processor, cause the processor to:

store the generated one or more models in association with the user.

14. The computer program product of claim 11, wherein the computer readable storage medium further has instructions encoded thereon that, when executed by the processor, cause the processor to:

play audio data associated with a specific position relative to the user's head via the audio system;

receive an identified position of the played audio data relative to the user's head from the user; and modify one or more of the generated models based at least in part on the specific position associated with the played audio data and the identified position of the played audio data received from the user.

15. The computer program product of claim 14, wherein modify one or more of the generated models based at least in part on the specific position associated with the played audio data and the identified position of the played audio data received from the user comprises:

determine a difference between the specific position and the identified position; and modify one or more of the generated models to minimize the determined difference.

16. The computer program product of claim 15, wherein the computer readable storage medium further has instructions encoded thereon that, when executed by the processor, cause the processor to:

store the modified one or more generated models in association with the user.

17. The computer program product of claim 12, wherein prompt the user to modify the position the user's head relative to the audio source external to the audio system comprises:

prompt the user to modify an angle between a reference point on the user's head and an axis of the audio source external to the audio system.

18. The computer program product of claim 13, wherein play audio data including the plurality of frequencies and the plurality of amplitudes from the audio source external to the audio system worn by the user comprises:

play audio data including multiple time intervals, each time interval including audio data having a different amplitude and different frequency.

19. The computer program product of claim 18, wherein capture information describing vibration of portions of bones in the user's head caused by the frequencies and amplitudes included in the audio data using the bone transducers in the audio system comprises:

capture information describing vibration of portions of bones in the user's head during a time interval; and associate the captured information during the time interval with a frequency and an amplitude of the audio data during the time interval.

20. The computer program product of claim 12, wherein the computer readable storage medium further has instructions encoded thereon that, when executed by the processor, cause the processor to:

generate one or more control signals for the one or more bone transducers based on additional audio data, a control signal for a bone transducer describing vibration of the bone transducer; and play the additional audio data for the user via the audio system while providing the one or more control signals to the one or more bone transducers in the audio system.

21. A system comprising:

an audio system worn by a user, the audio system including a plurality of bone transducers contacting portions of bones in the user's head;

an audio source external to the audio system worn by a user, the audio source configured to play audio data including a plurality of frequencies and a plurality of amplitudes, the audio source a particular distance from the user's head;

a head-mounted display worn by the user that prompts the user to modify a position the user's head relative to the audio source external to the audio system, wherein the bone transducers in the audio system capture information for multiple positions of the user's head relative to the audio source external to the audio system, the captured information describing vibration of portions of bones in the user's head caused by the frequencies and amplitudes included in the audio data; and a console configured to generate one or more models associated with the bone transducers based on captured information describing vibration of portions of bones in the user's head caused by the frequencies and amplitudes included in the audio data, frequencies included in the audio data, amplitudes included in the audio data, positions of the user's head relative to the audio data, and the particular distance from the audio source external to the audio system to the user's head.

* * * * *